US011471722B2

(12) United States Patent
Lu

(10) Patent No.: US 11,471,722 B2
(45) Date of Patent: Oct. 18, 2022

(54) DUMBBELL AND EXERCISE SYSTEM HAVING DUMBBELL

(71) Applicant: YONGKANG WEIDE INDUSTRY AND TRADE CO., LTD., Yongkang (CN)

(72) Inventor: Huahua Lu, Yongkang (CN)

(73) Assignee: YONGKANG WEIDE INDUSTRY AND TRADE CO., LTD., Yongkang (CN)

( * ) Notice: Subject to any disclaimer, the term of this patent is extended or adjusted under 35 U.S.C. 154(b) by 132 days.

(21) Appl. No.: 17/072,063

(22) Filed: Oct. 16, 2020

(65) Prior Publication Data

US 2022/0096890 A1 Mar. 31, 2022

(30) Foreign Application Priority Data

Sep. 29, 2020 (CN) ..... 202022213521.9

(51) Int. Cl.
*A63B 21/075* (2006.01)
*A63B 21/072* (2006.01)
*A63B 71/00* (2006.01)

(52) U.S. Cl.
CPC ..... *A63B 21/075* (2013.01); *A63B 21/0726* (2013.01); *A63B 21/0728* (2013.01); *A63B 71/0036* (2013.01)

(58) Field of Classification Search
CPC ..... A63B 21/0726; A63B 21/0728; A63B 71/0036; A63B 21/072–075; A63B 21/004; A63B 21/00058; A63B 21/00061; A63B 21/00065; A63B 21/06–0604; A63B 21/4023; A63B 21/4033
See application file for complete search history.

(56) References Cited

U.S. PATENT DOCUMENTS 11,167,167 B1 * 11/2021 Weng ..... A63B 21/0726
11,219,795 B1 * 1/2022 Yao ..... A63B 71/0619
2002/0183174 A1 * 12/2002 Chen ..... A63B 21/075 482/108
2012/0309597 A1 * 12/2012 Liu ..... A63B 21/075 482/107

* cited by examiner

*Primary Examiner* — Joshua Lee
*Assistant Examiner* — Catrina A Letterman

(57) ABSTRACT

The present application discloses a dumbbell. The dumbbell includes: a hand-hold assembly, having a first channel and two opposite ends; two weight adjusting assemblies, rotatably connected with two ends of the hand-hold assembly respectively and rotated relative to the hand-hold assembly about a rotation axis; a plurality of weights, supported by the weight adjusting assembly; wherein, each weight adjusting assembly comprises a first cover connected with the end of the hand-hold assembly, a supporting base fixed to the first cover and having an upper sub-base and a lower sub-base spaced apart from the upper sub-base for forming a receiving space, and an engaging tube extending from the first channel into the receiving space and moved toward or away from the hand-hold assembly so that the engaging tube locks the weights or unlocks the weights.

12 Claims, 9 Drawing Sheets

DUMBBELL AND EXERCISE SYSTEM HAVING DUMBBELL

FIELD OF THE PRESENT DISCLOSURE

The present application relates to the technical field of an exercise equipment, in particular to an adjustable dumbbell.

DESCRIPTION OF RELATED ART

The dumbbell is a widely used fitness equipment that can be used to train arm muscle strength. However, a number of weights to be lifted will depend upon the exercise objectives of the user.

The dumbbell in the prior art can be adjusted by increasing or reducing the number of weights. However, it is inconvenient for users to lift or remove the weights from the dumbbell.

Therefore, a new dumbbell and an exercise system having the dumbbell are desired to solve the above mentioned problem.

SUMMARY

In one aspect, the present invention discloses a dumbbell. The dumbbell comprises: a hand-hold assembly, having a first channel and two opposite ends; two weight adjusting assemblies, connected with two ends of the hand-hold assembly respectively and rotated relative to the hand-hold assembly about a rotation axis; a plurality of weights, supported by the weight adjusting assembly; wherein, each weight adjusting assembly comprises a first cover rotatably connected with the end of the hand-hold assembly, a supporting base fixed to the first cover and having an upper sub-base and a lower sub-base spaced apart from the upper sub-base for forming a receiving space, and an engaging tube extending from the first channel into the receiving space and moved toward or away from the hand-hold assembly so that the engaging tube locks the weights or unlocks the weights.

In another aspect, the present invention discloses an exercise system. The exercise system comprises: a dumbbell comprising: a hand-hold assembly, having a first channel and two opposite ends; two weight adjusting assemblies, connected with two ends of the hand-hold assembly respectively and rotated relative to the hand-hold assembly about a rotation axis; a plurality of weights, supported by the weight adjusting assembly; wherein, each weight adjusting assembly comprises a first cover rotatably connected with the end of the hand-hold assembly, a supporting base fixed to the first cover and having an upper sub-base and a lower sub-base spaced apart from the upper sub-base for forming a receiving space, and an engaging tube extending from the first channel into the receiving space and moved toward or away from the hand-hold assembly so that the engaging tube locks the weights or unlocks the weights; a dumbbell seat, configured for carrying the dumbbell.

DETAILED DESCRIPTION OF THE EXEMPLARY EMBODIMENT

In the following, the technical schemes in the embodiments of the present application will be described clearly and completely with reference to the drawings of the embodiments of the present application. Obviously, the described embodiments are only a part of embodiments of the present application, not all of the embodiments. Based on the embodiments in the present application, all other embodiments obtained by ordinary technicians in the field without creative labor are within the scope of protection in the present application.

Figure 1:
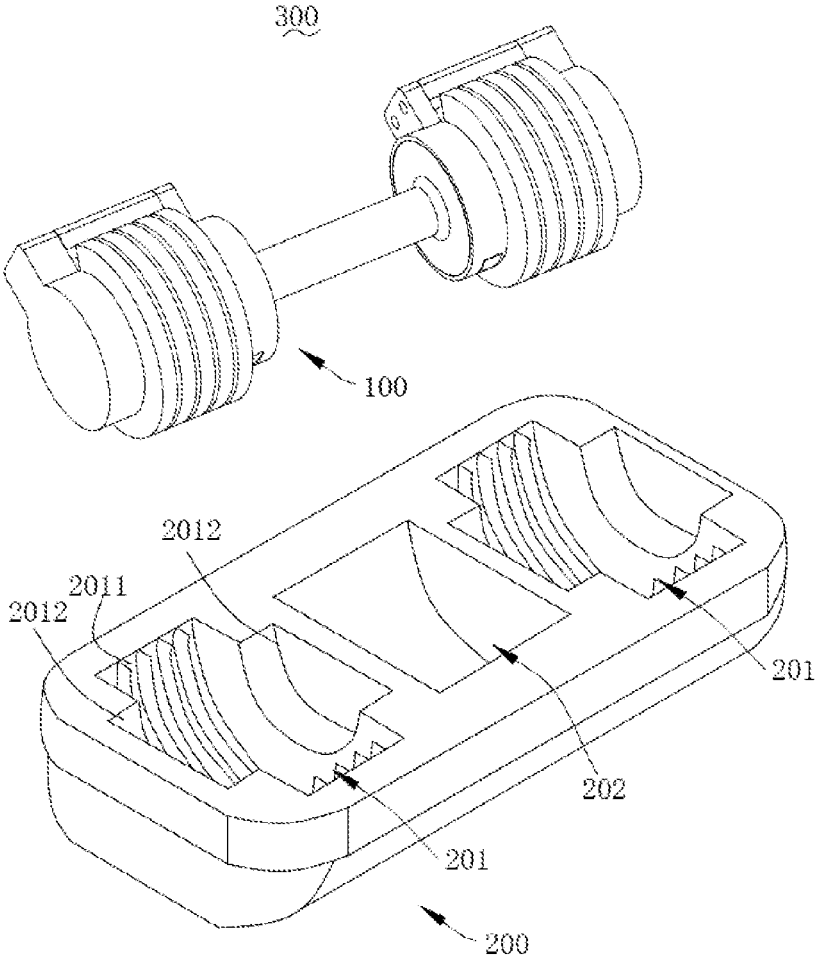
FIG. 1 is an schematic view of an exercise system in accordance with an embodiment of the present disclosure.
Figure 2:
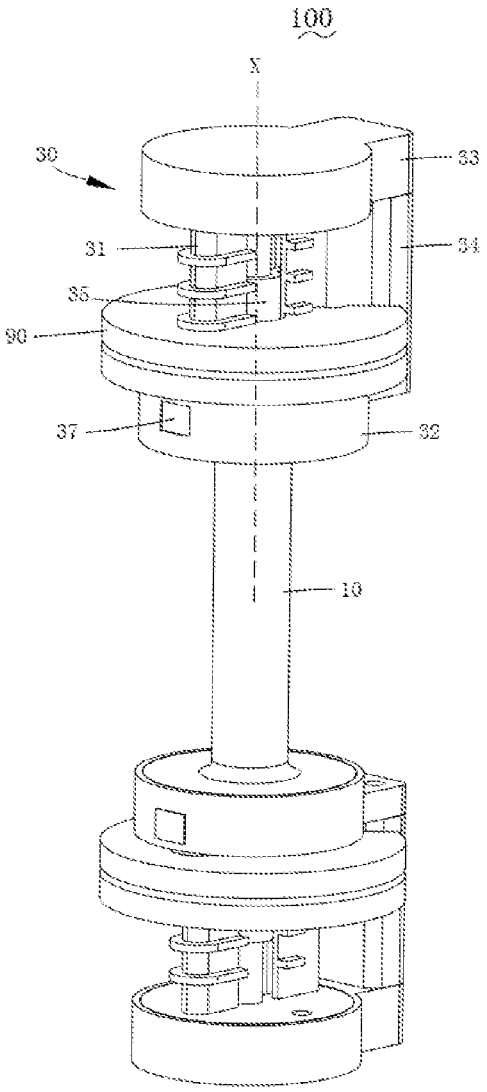
FIG. 2 is a perspective view of a dumbbell with some weights removed in accordance with the embodiment of the present disclosure.
Figure 3:
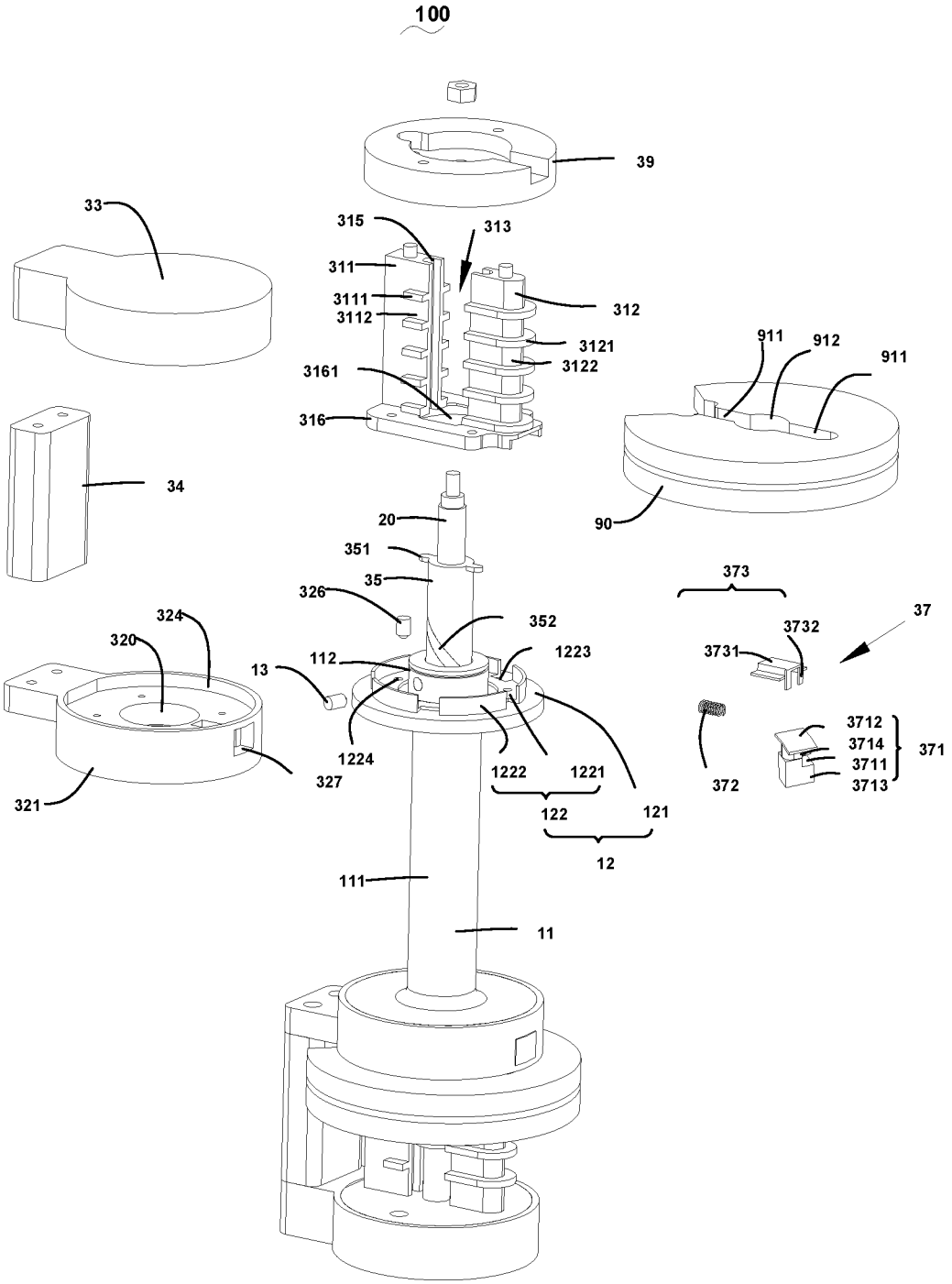
FIG. 3 is an exploded view of the dumbbell shown in FIG. 2.
Figure 4:
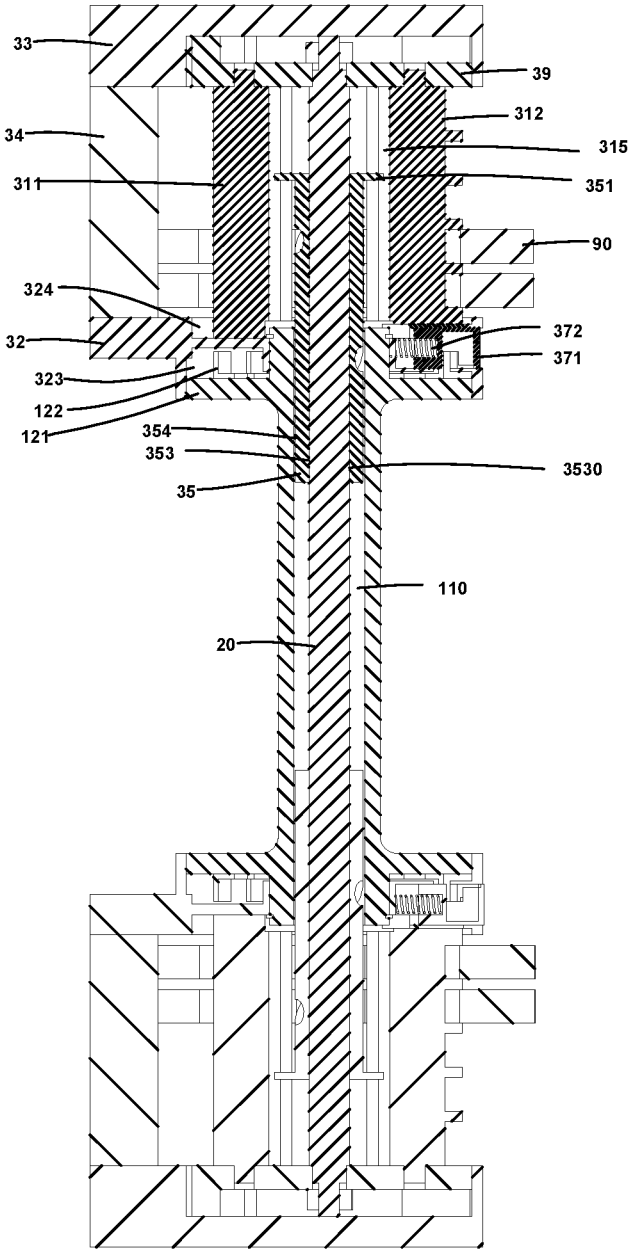
FIG. 4 is a cross-sectional view of the dumbbell shown in FIG. 2.
Figure 5A:
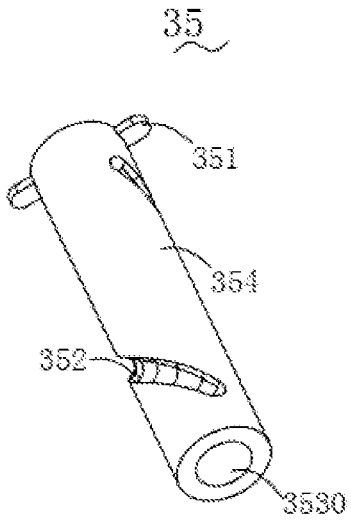
FIG. 5A and FIG. 5B are schematic perspective views of an engaging tube of the dumbbell shown in FIG. 2.
Figure 5B:
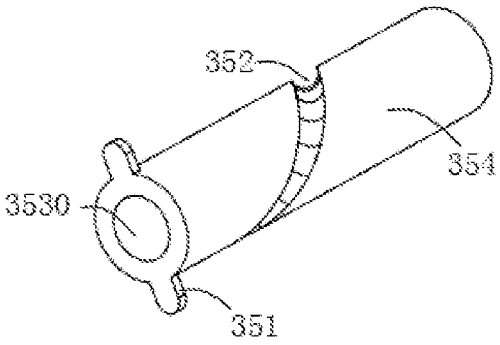
Figure 6:
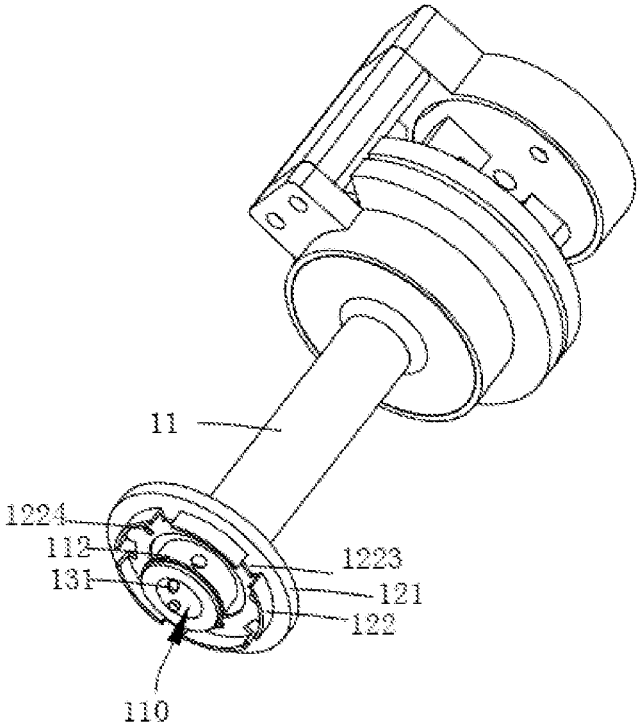
FIG. 6 is a schematic perspective view shown a hand-hold assembly of the dumbbell shown in FIG. 2.
Figure 7A:
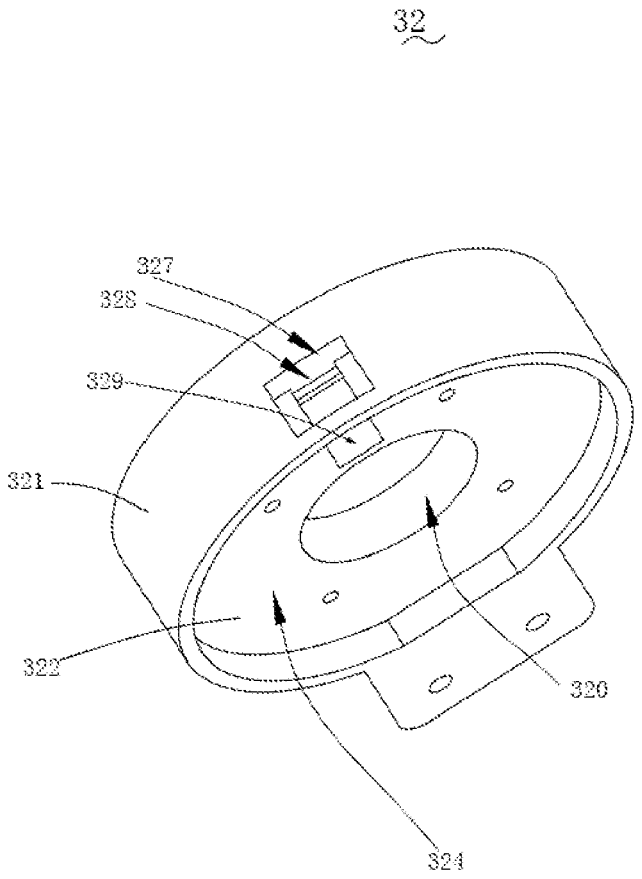
FIG. 7A and FIG. 7B are schematic perspective views of a first cover of the dumbbell shown in FIG. 2.
Figure 7B:
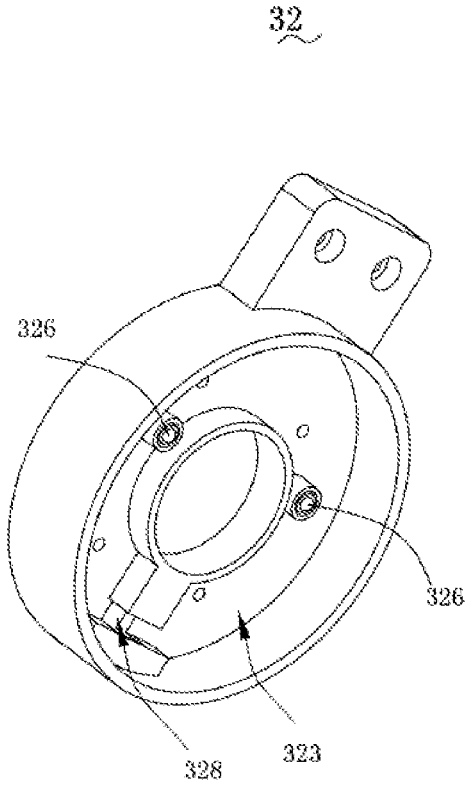
Figure 8:
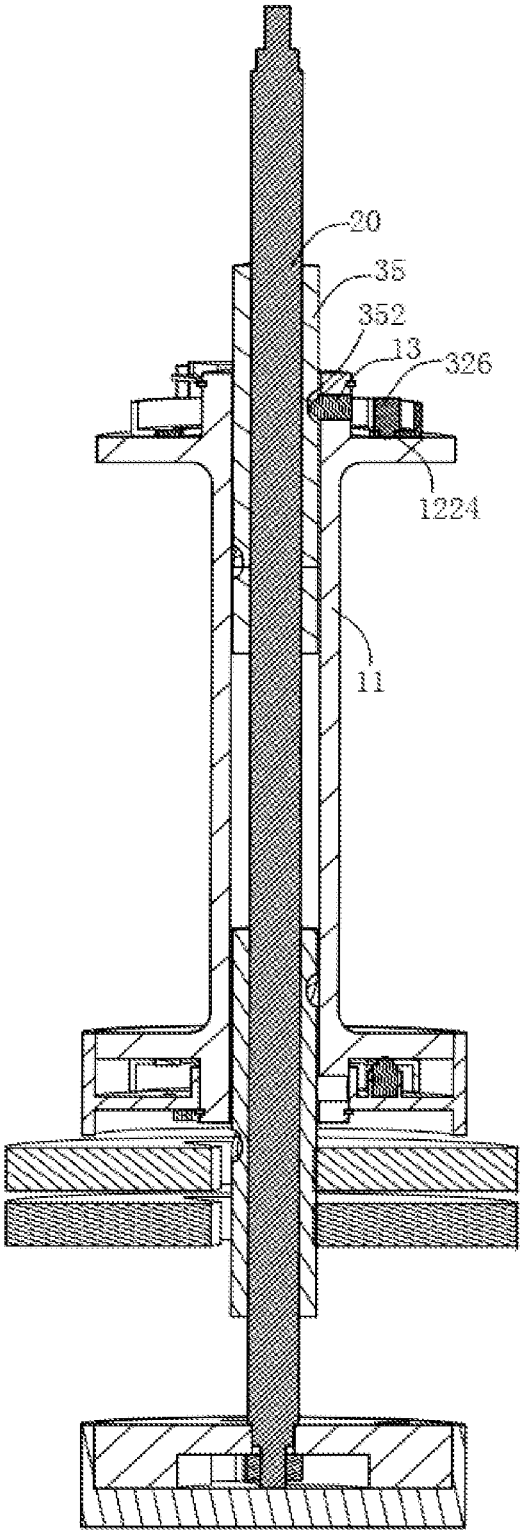
FIG. 8 schematically shows a connecting rod, a hand-hold assembly, an engaging tube shown in FIG. 2 assembled with each other.

Please referring to FIGS. 1 to 8, a dumbbell 100 according to the present application includes a hand-hold assembly 10 having two opposite ends 112, two weight adjusting assemblies 30 connected respectively to the ends of the hand-hold assembly 10, and a plurality of weights 90 detachably connected with the weight adjusting assembly 30. The weight adjusting assembly 30 is rotated relative to the hand-hold assembly 10 about an axial axis X.

The hand-hold assembly 10 includes a hollow hand-hold tube 11 having the opposite two ends 112 and two connection members 12 connected respectively with the two ends 112 of the hand-hold tube 11. The hand-hold tube 11 further includes a middle portion 111 disposed between the two ends 112. The hand-hold tube 11 further includes a first channel 110 passing therethrough. The hand-hold assembly 10 may include a soft sleeve, such as silicone sleeve, and the soft sleeve is sleeved on the middle portion 111 of the hand-hold tube 11. Each of the connection members 12 includes a carrying disk 121 sleeved around the end 112 of the hand-hold tube 11 and secured to the hand-hold tube 11 and an engaging ring 122 protruding from the carrying disk 121 in the axial direction toward the weight adjusting assembly 30. The engaging ring 122 has a ring shaped base wall 1221 secured to the carrying disk 121 and a plurality of side walls 1222 protruding in the axial direction and spaced apart from each other in an interval space 1223. A plurality of receiving holes 1224 are formed in the base wall 1221. In this embodiment, the receiving holes 1224 are defined corresponding to the side walls 1222 one by one.

The hand-hold assembly 10 further includes a pair of first elastic plungers 13. Each of the first elastic plungers 13 is mounted on the end 112 of the hand-hold tube 11 with a ball head 131 extending into the first channel 110.

The weight adjusting assembly 30 includes a supporting base 31 for supporting the weights 90, a first cover 32 rotatably connected with the carrying disk 121, and an engaging tube 35 movable axially upon rotation of the first cover 32 about the rotation axis X.

The supporting base 31 is fixed to the first cover 32 via screw. The supporting base 31 has an upper sub-base 311, a lower sub-base 312 spaced from the upper sub-base 311 for forming a receiving space 313, and a fixing part 316 connecting both the upper sub-base 311 and the lower sub-base 312 to the first cover 32. The fixing part 316 has a first through hole 3161 communicating with the receiving space 313. Each of the upper sub-base 311 and the lower sub-base 311 has a guiding slot 315 extending in the axial direction formed at a side close to the receiving space 313 and communicating with the receiving space 313. The upper sub-base 311 has a plurality of first partitioning fins 3111 extending from the upper sub-base 311 outwardly. The first partitioning fins 3111 are spaced apart from each other to form a plurality of first fin-free segments 3112. The lower sub-base 312 has a plurality of second U-shaped partitioning fins 3121 extending from the lower sub-base 312 outwardly. The second partitioning fins 3121 are spaced apart from each other to form a plurality of second fin-free segments 3122. The weight 90 is engaged with the first fin-free segment 3112 and the second fin-free segment 3212.

The engaging tube 35 has an inner wall 353 and an outer wall 354 opposite to the inner wall 353. The engaging tube 35 is hollow shaped. A second channel 3530 is formed in the inner wall 353, and a spiral groove 352 is formed on the outer wall 354. The engaging tube 35 has a pair of protruding parts 351 formed at an end of the engaging tube 35. One end of the engaging tube 35 is received in the first channel 110 and the other end of the engaging tube 35 extends into the receiving space 313 with the protruding parts 351 inserted into the guiding slots 315 respectively. The support base 31 rotates about the rotation axis X, and the engaging tube 35 also rotates by the protruding parts 351 co-rotates with the lower sub-base and upper sub-base. The engaging tube 35 can move away from or toward the hand-hold tube 11 in the receiving space 313 along the rotation axis X while the first cover 32 and the support base 31 rotates about the rotation axis. The first elastic plunger 13 is inserted into the spiral groove 352, and when the engaging tube 35 co-rotating with the support base 31 and the first cover 32, the first elastic plunger 13 would react on the engaging tube 35 so that a force is generated to drive the engaging tube 35 moving along the rotation axis.

The first cover 32 has a center hole 320 formed therein. The end 112 of the hand-hold tube 11 passes through the center hole 320. The first cover 32 has an annular wall 321 defining an annular space and a separating plate 322 connected with the annular wall 321 and configured to divide the annular space into a first recess 323 and a second recess 324. The center hole 320 is formed in the separating plate 322. The carrying disk 121 and the engaging ring 122 are received in the first recess 323 with the carrying disk 121 abutting against the annular wall 321.

The supporting base 31 is received in the second recess 324 and fixed to the separating plate 322 via screws. The first cover 32 further includes a pair of second elastic plungers 326 fixed to the separating plate 322 and received in the first recess 323. The second elastic plungers 326 are mounted on both sides of the center hole 320 and symmetrical about the center hole 320. When the first cover 32 rotates relative to the engaging ring 122, the second elastic plunger 326 is received in the receiving hole 1224 while the second elastic plunger 326 align with the receiving hole 1224 for indicating that a right position reached. When the first cover 32 is rotated to an angular position where the second elastic plunger 326 is axially aligned with the receiving hole 1224, a clicking sound is generated by the second elastic plunger 326 received in the receiving hole 1224.

The first cover 32 further includes a second through hole 327 formed in the annular wall 321, a third through hole 328 formed in the separating plate 322 and a mounting groove 329 formed on the separating plate 322 and located at the first recess 323. The second through hole 327 communicates with the third through hole 328 and the mounting groove 329.

The weight adjusting assembly 30 further includes an elastic locking assembly 37 for stopping or releasing the first cover 32 rotation relative to the hand-hold tube 11 about the rotation axis. The elastic locking assembly 37 includes a pressing block 371, an elastic member 372 and a fastening member 373. The pressing block 371 is T shaped, has a first block 3712 contacted by user, an engaging block 3713, and a connecting part 3714 with an avoiding space 3711 formed therein. The pressing block 371 is inserted into the second through hole 327 and the third through hole 328; the elastic member 372 is mounted in the mounting groove 329. One end of the elastic member 372 abuts against the engaging block 3713 and the other end thereof abuts against the wall of the mounting groove 329. The pressing block 371 can be moved along a direction perpendicular to the rotation axis under a force applied by the elastic member 372 so that the engaging block 3713 can be inserted into the third through hole 328 or removed from the third through hole 328.

The fastening member 373 includes cover body 3731 and a pair of finger portions 3732 extends bently from the cover body 3731. The finger portions 3732 inserted into the second through hole 327 with the connecting part 3714 sandwiched therebetween. The cover body 3731 covers on the mounting groove 329, and is pressed to the separating plate 322 by the fixing part 316 of the support base 31.

The fastening member 373 covers on the mounting groove 329 for preventing the pressing block 371 and the elastic member 372 from detached to the first cover 32. When the engaging block 3712 extends from the third through hole 328 into the interval space 1223 of the engaging ring 1222. The first cover 32 cannot be rotated relative to the hand-hold tube 11. When users presses on the pressing block 371 so that the avoiding space 3711 face the engaging ring 122, the first cover 32 can rotate relative to the hand-hold tube 11. The elastic member 372 may be a spring.

The weight 90 includes a pair of vertical grooves 911 and an arc groove 912. The arc groove 912 communicates with the vertical grooves 911. A width of the arc groove 912 is greater than that of the vertical groove 911. The first fin-free segment 3112 is received in one vertical groove 911, and the second fin-free segment 3122 is received in another vertical groove 911 and the engaging tube 35 is used for inserting into the arc groove 912 for locking the weight 90.

In operation, when users want to remove some weights 90 supported by the supporting base 31 and locked by the engaging tube 35, users need to rotate the first cover 32, the engaging tube 35 co-rotates with the first cover 32 and moved in the axial direction toward the hand-hold tube 11, the engaging tube 35 moved and out of the arc groove 912 of the weights 90. Thus, the weight 90 are released and can be removed from the support base 31. When users want to increase some weights 90 to the supporting base 31, users need to rotate the first cover 32 in the opposite direction, the engaging tube 35 co-rotates with the first cover 32 and moved in the axial direction away from the hand-hold tube 11, then the engaging tube 35 inserted into the arc groove 912 to lock the increased weights 90.

In other embodiment, the weight adjusting assembly 30 may include a second cover 33 and a strength block 39 received in the second cover 33. One end of the supporting base 31 is fixed to the first cover 32 and the other end of the supporting base 31 is fixed to the second cover 33 via the strength block 39.

In other embodiment, the dumbbell 100 further includes a connecting rod 20 having a smooth outer surface, the connecting rod 20 passes through the first channel 110 and the second channel 3530. Both ends of the connecting rod 20 are fixed to the strength blocks 39. With such configuration, the whole strength of the dumbbell can be enhanced and more and more weights can be supported.

In other embodiment, the weight adjusting assembly 30 may further include a third cover 34, the third cover 34 connected between the first cover 32 and the second cover 33 to form an U shaped cover body, which can enhance the whole strength of the dumbbell 100.

In this embodiment, an exercise system 300 may further includes a dumbbell seat 200. The dumbbell seat 200 is used for carrying the dumbbell 100. The dumbbell seat 200 includes a pair of weight carrying parts 201 corresponding to the weight adjusting assembly 30 and a middle part 202 located between the weight carrying parts 201. The weight carrying parts 201 includes a plurality of first slots 2011 for receiving the weights 90 respectively and a pair of second slots 2012 for receiving the first cover 32 and second cover 33 respectively. The second slots 2012 are disposed at both ends of the first slots 2011. The middle part 202 is formed as a groove.

The above description is only about some embodiments of the present application, and is not intended to limit the patent scope of the present application. Any equivalent structure or equivalent principle transformation made by using the description and drawings of the present application, or directly or indirectly applied in other related technical fields, are similarly included in the patent protection scope of the present application.

What is claimed is:

1. A dumbbell, comprising:

a hand-hold assembly, having a first channel and two opposite ends;

two weight adjusting assemblies, connected with the two opposite ends of the hand-hold assembly respectively and rotated relative to the hand-hold assembly about a rotation axis;

a plurality of weights, supported by the weight adjusting assembly; wherein, each weight adjusting assembly comprises a first cover rotatably connected with one of the two opposite ends of the hand-hold assembly, a supporting base fixed to the first cover and having an upper sub-base and a lower sub-base spaced apart from the upper sub-base for forming a receiving space, and an engaging tube extending from the first channel into the receiving space and moved toward or away from the hand-hold assembly so that the engaging tube locks the weights or unlocks the weights, the hand-hold assembly comprises a hand-hold tube and a pair of connection members connected respectively with the ends of the hand-hold assembly; the first cover has a center hole; each of the two opposite ends of the hand-hold assembly passes through the respective center hole, the hand-hold assembly further comprises a pair of first elastic plungers, the first elastic plungers are respectively mounted on the two opposite ends of the hand-hold assembly and extend into the corresponding first channel.

2. The dumbbell according to claim 1, wherein, the engaging tube has an inner wall and an outer wall opposite to the inner wall, a second channel formed in the inner wall, and a spiral groove is formed on the outer wall; each of the pair of first elastic plungers is inserted into the respective spiral groove.

3. The dumbbell according to claim 2, wherein, each of the weight adjusting assemblies further comprises a second cover and a strength block received in the second cover; one end of the supporting base is fixed to the first cover and the other end of the supporting base is fixed to the strength block.

4. The dumbbell according to claim 3, wherein, each of the weight adjusting assemblies further comprises a third cover connecting the first cover to the second cover.

5. The dumbbell according to claim 4 further comprising a connecting rod passing through the first channel and the second channel with both ends thereof fixed to the strength blocks.

6. The dumbbell according to claim 1, wherein, each of the pair of connection members comprises a carrying disk and an engaging ring protruded from the carrying disk in g rotation axis direction toward the first cover; the first cover assembled with the carrying disk and abuts against the carrying disk.

7. The dumbbell according to claim 6, wherein, the weight adjusting assembly further comprises an elastic locking assembly mounted on the first cover, the elastic locking assembly comprises a pressing block, an elastic member with one end connected with the pressing block and the other end abuts against the first cover;

the engaging ring comprises a plurality of interval space;

the pressing block is pushed into the interval space so that the first cover stops rotating; or, the pressing block is not pushed into the interval space so that the first cover rotates about the rotation axis.

8. The dumbbell according to claim 7, wherein, the weight adjusting assembly further comprises a second elastic plunger mounted on the first cover; the engaging ring further comprises a receiving hole for receiving the second elastic plunger while the first cover rotates to a right position where the second elastic plunger is axially aligned with the receiving hole.

9. The dumbbell according to claim 1, wherein, each of the upper sub-base and the lower sub-base has a guiding slot, the guiding slots are formed on a side of the upper sub-base and a side of the lower sub-base close to the receiving space; the engaging tube has two protruding parts located at an end thereof, the protruding parts are inserted into the guiding slots respectively.

10. An exercising system, comprising:

a dumbbell comprising: a hand-hold assembly, having a first channel and two opposite ends;

two weight adjusting assemblies, rotatably connected with the two opposite ends of the hand-hold assembly respectively and rotated relative to the hand-hold assembly about a rotation axis;

a plurality of weights, supported by the weight adjusting assembly; wherein, each weight adjusting assembly comprises a first cover rotatably connected with one of the two opposite ends of the hand-hold assembly, a supporting base fixed to the first cover and having an upper sub-base and a lower sub-base spaced apart from the upper sub-base for forming a receiving space, and an engaging tube extending from the first channel into the receiving space and moved toward or away from the hand-hold assembly so that the engaging tube locks the weights or unlocks the weights, the hand-hold assembly comprises a hand-hold tube and a pair of connection members connected respectively with the ends of the hand-hold assembly; the first cover has a center hole; each of the two opposite ends of the hand-hold assembly passes through the respective center hole, the hand-hold assembly further comprises a pair of first elastic plungers, the first elastic plungers are respectively mounted on the two opposite ends of the hand-hold assembly and extend into the corresponding first channel;

a dumbbell seat, configured for carrying the dumbbell.

11. The exercising system according to claim 10, wherein, the dumbbell seat comprises a pair of weight carrying parts and a middle part located between the weight carrying parts; the weight carrying parts is configured for carrying the weights and the weight adjusting assemblies.

12. The exercising system according to claim 11, wherein, the middle part is formed as a groove.

* * * * *